US010940481B2

(12) United States Patent
Rust et al.

(10) Patent No.: US 10,940,481 B2
(45) Date of Patent: Mar. 9, 2021

(54) APPARATUS AND METHOD FOR A TRAMP IRON RELIEF SYSTEM

(71) Applicant: Kolberg-Pioneer, Inc., Yankton, SD (US)

(72) Inventors: Joe Rust, Yankton, SD (US); Gary Engel, Yankton, SD (US)

(73) Assignee: Kolberg-Pioneer, Inc., Yankton, SD (US)

( * ) Notice: Subject to any disclaimer, the term of this patent is extended or adjusted under 35 U.S.C. 154(b) by 558 days.

(21) Appl. No.: 15/466,374

(22) Filed: Mar. 22, 2017

(65) Prior Publication Data

US 2017/0274383 A1 Sep. 28, 2017

Related U.S. Application Data

(60) Provisional application No. 62/311,959, filed on Mar. 23, 2016.

(51) Int. Cl.
*B02C 1/02* (2006.01)
*B02C 1/00* (2006.01)
*B02C 1/04* (2006.01)

(52) U.S. Cl.
CPC ..... *B02C 1/025* (2013.01); *B02C 1/00* (2013.01); *B02C 1/005* (2013.01); *B02C 1/02* (2013.01); *B02C 1/04* (2013.01)

(58) Field of Classification Search
CPC ..... B02C 1/025; B02C 1/005; B02C 1/04; B02C 1/02; B02C 1/00
USPC ..... 241/264, 268, 37
See application file for complete search history.

(56) References Cited

U.S. PATENT DOCUMENTS

| | | | | |
|---|---|---|---|---|
| 5,765,769 | A * | 6/1998 | Kaya | B02C 1/025 241/264 |
| 6,375,105 | B1 * | 4/2002 | Haven | B02C 1/025 241/264 |
| 7,344,097 | B2 * | 3/2008 | Young | B02C 1/025 241/268 |
| 2015/0107232 | A1 * | 4/2015 | Burhoff | B02C 1/025 60/327 |

* cited by examiner

*Primary Examiner* — Ghassem Alie
*Assistant Examiner* — Nhat Chieu Q Do
(74) *Attorney, Agent, or Firm* — Chambliss, Bahner & Stophel, P.C.

(57) ABSTRACT

A tramp iron relief system for a crusher. The preferred system includes a tramp iron relief cylinder, a relief valve adapted to open when oil pressure within said tramp iron relief cylinder exceeds a pre-designated limit, a tramp iron relief cylinder manifold block that is adapted to control the flow of oil into and out of the tramp iron relief cylinder, a tension cylinder, a tension cylinder manifold block adapted to control the flow of oil into and out of the tension cylinder, a tank line accumulator, and a hydraulic line to convey oil between the tank line accumulator, the tramp iron relief cylinder, and the tension cylinder. A method for controlling the movement of the tramp iron relief cylinder including reducing the pressure in the rod end of the tramp iron relief cylinder during normal operations of the crusher.

9 Claims, 6 Drawing Sheets

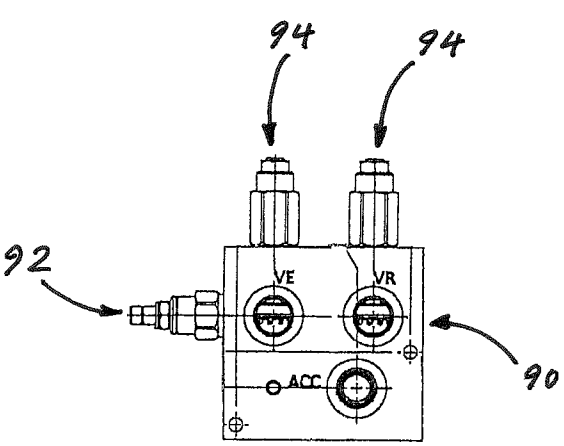
FIGURE 5C
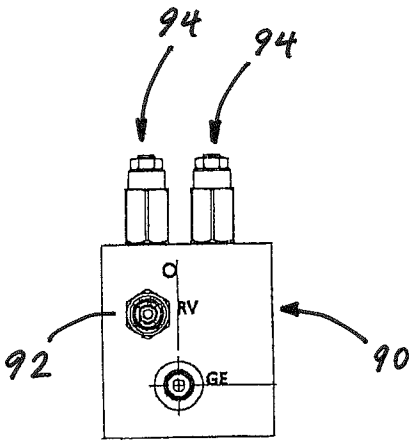
FIGURE 5A
FIGURE 5B

APPARATUS AND METHOD FOR A TRAMP IRON RELIEF SYSTEM

CROSS-REFERENCE TO RELATED APPLICATION

This application relates back to and claims the benefit of priority from U.S. Provisional Application for Patent Ser. No. 62/311,959, titled "Tramp Iron Relief System," which was filed on Mar. 23, 2016.

FIELD OF THE INVENTION

The present invention relates generally to jaw crushers and, more particularly, to hydraulic tramp iron relief systems for jaw crushers.

BACKGROUND AND DESCRIPTION OF THE PRIOR ART

Jaw crushers or rock crushers (hereinafter generally "jaw crushers") known in the art typically include a stationary jaw and a moveable jaw spaced apart to define between them a "crushing gap" or "crushing chamber." As the moveable jaw reciprocates toward and away from the stationary jaw, aggregate material fed into the crushing chamber is crushed by crushing surfaces on each of the jaws to produce an aggregate product principally of a pre-determined size. Aggregate material fed into the crushing chamber from time to time includes uncrushable material, commonly known in the field as "tramp iron." This tramp iron generally hinders or interrupts the operation of the jaw crusher and can cause damage to components of the jaw crusher.

Tramp iron relief ("TIR") systems have been developed in order to address the problems presented by tramp iron. As existing tramp iron relief systems generally present one or more drawbacks, there exists a continuing need for improvements in tramp iron relief systems for jaw crushers. For example, conventional TIR systems allow excessive movement of the tramp iron relief system cylinders during normal crushing operations. Further, conventional TIR systems have a tendency to experience pressure spikes in the rod end of the tramp iron relief cylinders. Also, conventional TIR systems sometimes cause the jaw crusher to shut down in the absence of a tramp iron event. Moreover, conventional TIR systems are often expensive to produce, maintain, repair, and replace.

It would be desirable, therefore, if such an apparatus and method for a TIR system could be provided that would reduce the movement of the tramp iron relief system cylinders during normal crushing operations. It would further be desirable if such an apparatus and method for a TIR system could be provided that would reduce the pressure in the rod end of the tramp iron relief cylinders and prevent pressure spikes in the rod end of the tramp iron relief cylinders. It would also be desirable if such an apparatus and method for a TIR system could be provided that would be less expensive to produce, maintain, repair, and replace. It would further be desirable if such an apparatus and method for a TIR system could be provided in which the tension cylinder and accumulator produce sufficient pressure levels. It would moreover be desirable if such an apparatus and method for a TIR system could be provided that would use only one oil supply and only one pressure transducer or pressure switch. It would also be desirable if such an apparatus and method for a TIR system could be provided that does not undesirably cause the jaw crusher to shut down in the absence of a tramp iron event.

Advantages of the Preferred Embodiments of the Invention

It is an advantage of the preferred embodiments of the invention claimed herein to provide an apparatus and method for a tramp iron relief system that reduces the movement of the tramp iron relief system cylinders during not crushing operations. It is also an advantage of the preferred embodiments of the invention claimed herein to provide an apparatus and method for a tramp iron relief system that reduces the pressure in the rod end of the tramp iron relief cylinders and prevents pressure spikes in the rod end of the tramp iron relief cylinders. It is another advantage of the preferred embodiments of the invention claimed herein to provide an apparatus and method for a tramp iron relief system that applies pressure to the base end of the tramp iron relief cylinder. It is still another advantage of the preferred embodiments of the invention claimed herein to provide an apparatus and method for a tramp iron relief system that is less expensive to produce, maintain, repair, and replace. It is a further advantage of the preferred embodiments of the invention claimed herein to provide an apparatus and method for a tramp iron relief system that reduces wear on the parts of the system and operating costs. It is a still further advantage of the preferred embodiments of the invention to provide an apparatus and method for a tramp iron relief system in which the tension cylinder and accumulator produce sufficient pressure levels. In addition, it is an advantage of the preferred embodiments of the invention claimed herein to provide a tramp iron relief system that uses only one oil supply and only one pressure transducer or pressure switch. It is also an advantage of the preferred embodiments of the invention claimed herein to provide a tramp iron relief system that does not undesirably cause the jaw crusher to shut down in the absence of a tramp iron event.

Additional advantages of the preferred embodiments of the invention will become apparent from an examination of the drawings and the ensuing description.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such ten is in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

Terms concerning attachments, coupling and the like, such as "connected" and "interconnected", refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest possible construction consistent with such definitions, as follows:

The term "oil communication" refers to an operative connection or association between components such as a storage vessel and a discharge port which allows for flow of particulate material from one such component to the other.

The term "oil" refers to any fluid suitable for use in a hydraulic tramp iron relief system.

SUMMARY OF THE INVENTION

The apparatus of the invention comprises a tramp iron relief system for a jaw crusher having a movable jaw and a stationary jaw defining a crushing chamber for crushing aggregate material. The preferred tramp iron relief system comprises a tramp iron relief cylinder having a rod end and a base end and being adapted to limit pressure on the movable jaw of the jaw crusher when tramp iron is present in the crushing chamber. The preferred tramp iron relief cylinder is also adapted to receive oil to exert pressure on the movable jaw during crushing operations and includes a relief valve that is adapted to provide a quick discharge path for oil in the tramp iron relief cylinder when open. The preferred relief valve is also adapted to open when oil pressure within the tramp iron relief cylinder exceeds a pre-designated limit. The preferred tramp iron relief system also comprises a tramp iron relief cylinder manifold block that is adapted to control the flow of oil into and out of the tramp iron relief cylinder. The preferred tramp iron relief system further comprises a tension cylinder that is adapted to provide tension force to keep the tramp iron relief cylinder in operative contact with the movable jaw of the jaw crusher during crushing operations. The preferred tension cylinder is also adapted to receive oil. The preferred tramp iron relief system still further comprises a tension cylinder manifold block that is adapted to control the flow of oil into and out of the tension cylinder, a tank line accumulator that is adapted to receive and hold oil discharged from the tramp iron relief cylinder when the relief valve is open, and a hydraulic network to convey oil between the tank line accumulator, the tramp iron relief cylinder, and the tension cylinder.

The method of the invention comprises a method for reducing the movement of a tramp iron relief cylinder on a jaw crusher during normal operations. The preferred method comprises providing a tramp iron relief system for a jaw crusher having a movable jaw and a stationary jaw defining a crushing chamber for crushing aggregate material. The preferred tramp iron relief system comprises a tramp iron relief cylinder having a rod end and a base end and being adapted to release pressure on the movable jaw of the jaw crusher when tramp iron is present in the crushing chamber. The preferred tramp iron relief cylinder is also adapted to receive oil to exert pressure on the movable jaw during crushing operations and includes a relief valve that is adapted to provide a quick discharge path for oil in the tramp iron relief cylinder when open. The preferred relief valve is also adapted to open when oil pressure within the tramp iron relief cylinder exceeds a pre-designated limit. The preferred tramp iron relief system also comprises a tramp iron relief cylinder manifold block that is adapted to control the flow of oil into and out of the tramp iron relief cylinder. The preferred tramp iron relief system further comprises a tension cylinder that is adapted to provide tension force to keep the tramp iron relief cylinder in operative contact with the movable jaw of the jaw crusher during crushing operations. The preferred tension cylinder is also adapted to receive oil. The preferred tramp iron relief system still further comprises a tension cylinder manifold block that is adapted to control the flow of oil into and out of the tension cylinder, a tank line accumulator that is adapted to receive and hold oil discharged from the tramp iron relief cylinder when the relief valve is open, and a hydraulic line to convey oil between the tank line accumulator, the tramp iron relief cylinder, and the tension cylinder. The preferred method also comprises reducing the pressure in the rod end of the tramp iron relief cylinder during normal operations of the jaw crusher.

In order to facilitate an understanding of the invention, the preferred embodiments of the invention, as well as the best mode known by the inventor for carrying out the invention, is illustrated in the drawings, and a detailed description thereof follows. It is not intended, however, that the invention be limited to the particular embodiment described or to use in connection with the apparatus illustrated herein. Therefore, the scope of the invention contemplated by the inventor includes all equivalents of the subject matter recited in the claims, as well as various modifications and alternative embodiments such as would ordinarily occur to one skilled in the art to which the invention relates. The inventor expects skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and in which:

FIG. 5A is a first or front side view of an example embodiment tension cylinder manifold block for the tramp iron relief system illustrated in FIG. 1.

FIG. 5B is a right side view of the tension cylinder manifold block illustrated in FIG. 5A.

FIG. 5C is a left side view of the tension cylinder manifold block illustrated in FIGS. 5A-5B.

DESCRIPTION OF THE PREFERRED EMBODIMENTS OF THE INVENTION

Figure 2:
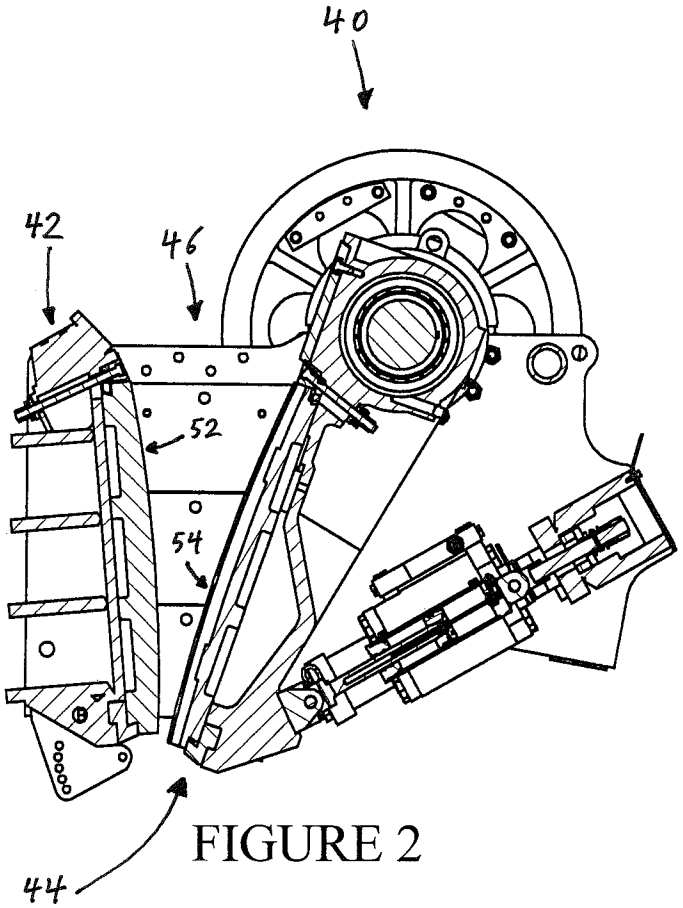
FIG. 2 is a sectional side view of an exemplary jaw crusher.

This description of preferred embodiments of the invention is intended to be read in connection with the accompanying drawings, which are to be considered part of the entire written description of this invention. The drawing figures are not necessarily to scale, and certain features of the invention may be shown exaggerated in scale or in somewhat schematic form in the interest of clarity and conciseness.

Figure 1:
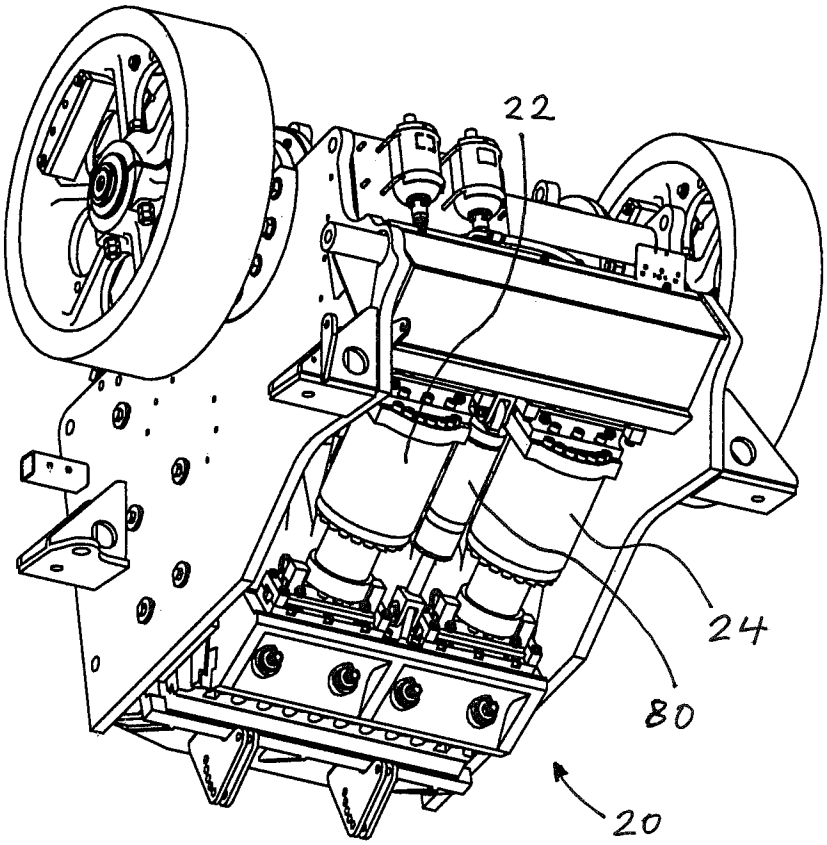
FIG. 1 is a perspective view of the preferred tramp iron relief system on an exemplary jaw crusher in accordance with the present invention.

Referring now to the drawings, FIG. 1 is a perspective view of the preferred tramp iron relief system on an exemplary jaw crusher in accordance with the present invention. As shown in FIG. 1, the preferred tramp iron relief system is designated generally by reference numeral 20. Preferred tramp iron relief system 20 comprises tramp iron relief cylinders 22 and 24 and tension cylinder 80.

Referring now to FIG. 2, an example embodiment of a jaw crusher is illustrated. As shown therein, the exemplary jaw crusher is designated generally by reference numeral 40. Exemplary jaw crusher 40 comprises stationary jaw 42, moveable jaw 44 spaced apart from the stationary jaw so as to define between them crushing chamber 46. As moveable jaw 44 reciprocates toward and away from stationary jaw 42, aggregate material fed into the crushing chamber 46 is crushed by crushing surfaces 52 and 54 which are disposed on stationary jaw 42 and moveable jaw 44, respectively, in order to produce an aggregate product principally of a pre-determined size.

Figure 3:
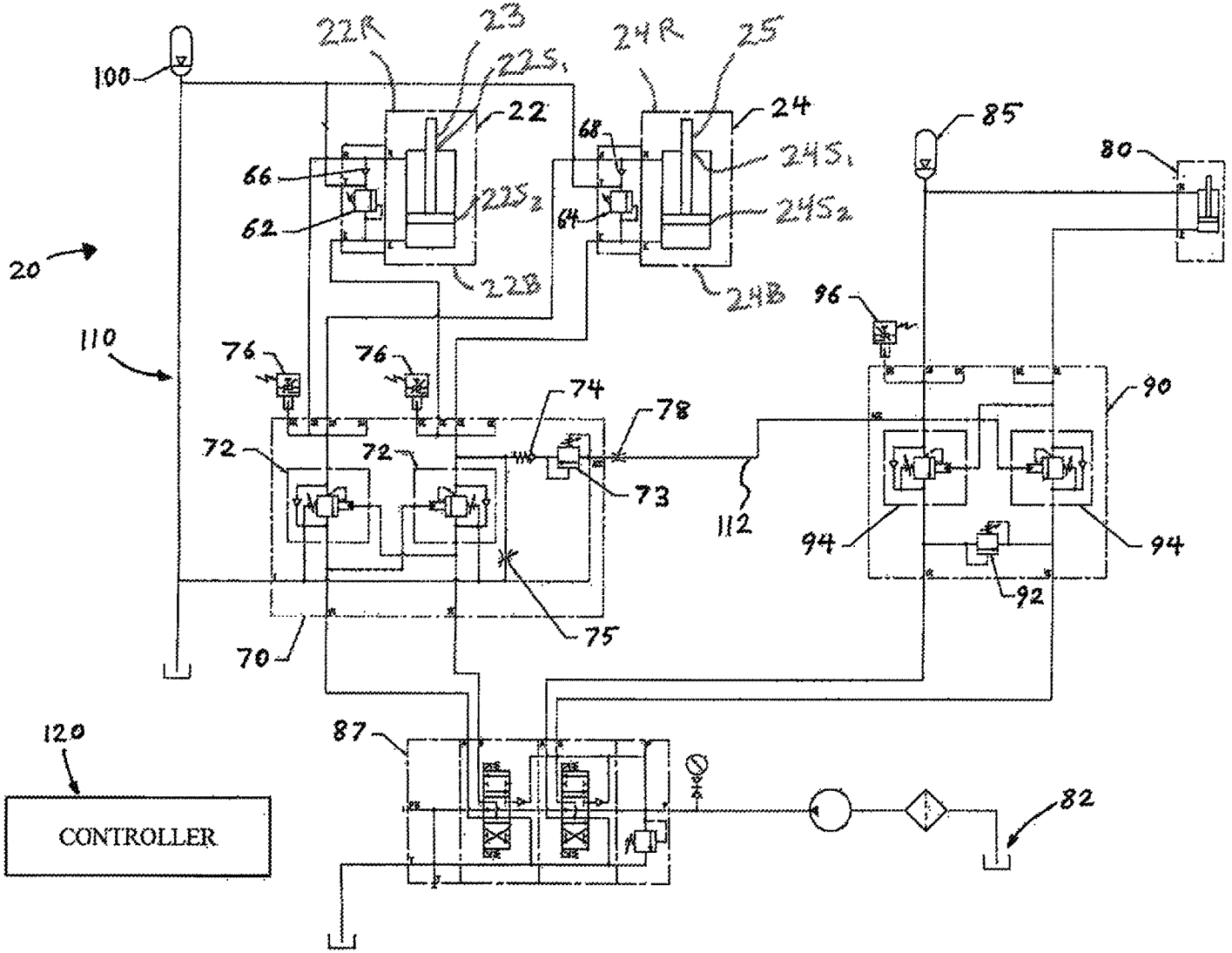
FIG. 3 is a schematic view of a preferred embodiment of a tramp iron relief system for a jaw crusher.

Referring now to FIG. 3, a preferred embodiment of a tramp iron relief system for a jaw crusher is shown in schematic form. As shown in FIG. 3, the preferred tramp iron relief system comprises a pair of tramp iron relief cylinders 22 and 24 adapted to release pressure on the movable jaw of the jaw crusher when tramp iron is present in the crushing chamber. More particularly, preferred tramp iron relief cylinders 22 and 24 are adapted to receive oil to exert pressure on the movable jaw during crushing operations. Preferred tramp iron relief cylinders 22 and 24 include relief valves 62 and 64, respectively. Preferred relief valves 62 and 64 are adapted to provide a quick discharge path for oil in preferred tramp iron relief cylinders 22 and 24 when open. Preferred relief valves 62 and 64 are adapted to open when the oil pressure within tramp iron relief cylinders 22 and 24 exceeds a pre-designated limit. Preferred tramp iron relief cylinders 22 and 24 also include check valves 66 and 68, respectively . Preferred tramp iron relief system 20 comprises tramp iron relief cylinder manifold block 70. Preferred tramp iron relief cylinder manifold block 70 is adapted to control the flow of oil into and out of tramp iron relief cylinders 22 and 24, respectively.

Still referring to FIG. 3, preferred tramp iron relief cylinder manifold block 70 comprises two counterbalance valves 72, pressure reducing valve 73, check valve 74, pressure release valve 75, and two pressure transducers 76 or pressure gauges. Preferred tramp iron relief cylinder manifold block 70 also have orifice fitting 78 to control the flow rate from tension cylinder accumulator 85 to pressure reducing valve 73. Preferably, the pilot oil for counterbalance valves 72 comes from the valve side so that pressure can be held on both sides of each of preferred tramp iron relief cylinders 22 and 24. Oil that enters from preferred tension cylinder accumulator 85 through preferred orifice fitting 78 then goes through preferred pressure reducing valve 73 and through preferred check valve 74 before it enters the base end of preferred tramp iron relief cylinders 22 and 24. Preferred pressure release valve 75 is adapted to drop the pressure on the entire tramp iron relief system 20 when opened; generally, pressure release valve 75 is used only to drop the pressure on tramp iron relief system 20 when performing maintenance or repairs. Preferred pressure transducers 76 and/or pressure gauges are used only to monitor the pressure levels in preferred tramp iron relief cylinders 22 and 24.

Still referring to FIG. 3, preferred tramp iron relief system 20 also comprises tension cylinder 80. Preferred tension cylinder 80 is adapted to provide tension force to keep tramp iron relief cylinders 22 and 24 in operative contact with the movable jaw of the jaw crusher during normal crushing operations. Preferred tension cylinder 80 is adapted to receive oil from an oil source such as tank 82. Preferred tramp iron relief system 20 also comprises tension cylinder manifold block 90. Preferred tension cylinder manifold block 90 is adapted to control the flow of oil into and out of tension cylinder 80. Preferred tramp iron relief system 20 further comprises tank line accumulator 100. Preferred tank line accumulator 100 is adapted to receive and hold oil discharged from preferred tramp iron relief cylinders 22 and 24 when preferred relief valves 62 and 64 are open. Preferred tramp iron relief system 20 still further comprises hydraulic network 110. Preferred hydraulic network 110 is adapted to convey oil between preferred tank line accumulator 100, preferred tramp iron relief cylinders 22 and 24, and preferred tension cylinder 80.

Still referring to FIG. 3, preferred tension cylinder manifold block 90 controls the pressure in preferred tension cylinder 80 using an adjustable relief valve 92 and is plumbed to tension cylinder accumulator 85. Preferred tension cylinder manifold block 90 further comprises adjustable relief valve 92 and generally also has attached at least one of pressure transducer 96 and a pressure switch. Preferably, when the pressure in tension cylinder accumulator 85 (as measured, preferably, by pressure transducer 96) drops to a specific pressure, control valve 87 is activated to supply more oil to tension cylinder accumulator 85, which increases the pressure to the level of the relief setting. Hydraulic line 112 (part of hydraulic network 110) from tension cylinder accumulator 85 is plumbed to preferred tramp iron relief cylinder manifold block 70 which holds preferred tramp iron relief cylinders 22 and 24 in the desired position. The oil from preferred tension cylinder accumulator 85 passes through preferred orifice fitting 78 and then preferred adjustable pressure reducing valve 73 to reduce the pressure to the desired amount for the base ends 22B and 24B of tramp iron relief cylinders 22 and 24, respectively. As a result, the pressure in the rod ends 22R and 24R of preferred tramp iron relief cylinders 22 and 24, respectively, can be reduced and prevent the jaw from closing down. Preferably, the oil then passes through preferred check valve 74 which holds the oil in preferred tramp iron relief cylinders 22 and 24 and prevents the high crushing pressure from acting on preferred adjustable pressure reducing valve 73. The oil is then held in preferred tramp iron relief cylinders 22 and 24 with preferred dual counterbalance valves 72 set at approximately 6000 psi. In the preferred embodiments of tramp iron relief system 20, the pressure in the rod ends of preferred tramp iron relief cylinders 22 and 24 is maintained below approximately 4500 psi.

Still referring to FIG. 3, preferred tramp iron relief system 20 also comprises controller 120. Controller 120 is adapted to activate and/or adjust control valve 87 in response to signals from pressure transducer 96 and/or other pressure switches, pressure gauges, sensors, and monitoring components of tramp iron relief system 20. In some example embodiments of the present general inventive concept, controller 120 also regulates other components of tramp iron relief system 20.

Still referring to FIG. 3, in the preferred embodiments of the tramp iron relief system in accordance with the present invention, control valve 87 comprises a two-section solenoid valve, which controls where the oil goes. If both sections are in neutral, the oil continues through the solenoid valve. When the A coil on the first section is active, oil will fill tension cylinder accumulator 85 until the pressure reaches the relief setting in tension cylinder manifold block 90, and then it will go through the adjustable relief valve 92 and back to tank 82. Preferably, the A coil can be activated by a signal from the controller 120 or by a manual input. The only time coil B is activated (or the manual override for this section is used) is for performing maintenance or repairs. During maintenance or repairs, the oil will enter the base end of tension cylinder 80 to push the pitman away from tramp iron relief cylinders 22 and 24, and it will also shift the counterbalance valve which allows all the oil from the tension cylinder accumulator 85 to go to tank 82.

Also in the preferred embodiments of the tramp iron relief system in accordance with the present invention, the second section of the solenoid valve controls the position of the tramp iron relief cylinders. When coil A is activated, oil flows to the tramp iron relief manifold block to retract the tramp iron relief cylinders and open the counterbalance valve on the base end. Oil flows into the rod end of the tramp iron relief cylinders and out of the base end of the tramp iron relief cylinders and back to the tank. The oil from the tension cylinder accumulator will flow into the rod end of the tension cylinder to keep the pitman tight against the tramp iron relief cylinders, but oil will also flow through the orifice fitting, the pressure reducing valve, and the check valve, and then return to the tank. This is a primary purpose for the orifice fitting. When the pressure drops too low (too much oil has left the tension cylinder accumulator), coil A on the first section will be activated by the controller and oil will be sent to the tension cylinder manifold so the tramp iron relief cylinders will stop retracting until the pressure on the tension cylinder accumulator is restored.

Further, in the preferred embodiments of the tramp iron relief system in accordance with the present invention, when coil B is activated, oil flows to the tramp iron relief manifold block to extend the tramp iron relief cylinders. The oil enters the base end of the cylinder and opens the counterbalance valve on the rod end. The oil from the rod end of the tramp iron relief cylinders then goes to the tank. This action also forces the tension cylinder to extend and forces oil out of the rod end of the tension cylinder and into the tension cylinder accumulator. If the pressure in the accumulator gets too high, the counterbalance valve in the tension cylinder manifold will open and allow the excess oil to go to the tank. The pressure in the tension cylinder accumulator holds the tension cylinder base end counterbalance valve open so that the tension cylinder can pull oil into the base end from the tank port of the solenoid valve.

Referring now to FIGS. 4A-4F, preferred tramp iron relief cylinder manifold block 70 is illustrated. As shown in FIGS. 4A-4F, preferred tramp iron relief cylinder manifold block 70 comprises counterbalance valves 72, pressure reducing valve 73, check valve 74, and pressure release valve 75. As previously shown in FIG. 3 (but not shown in FIGS. 4A-4F), preferred tramp iron relief cylinder manifold block 70 generally also has attached at least one of pressure transducer 76 and a pressure gauge.

Figure 4A:
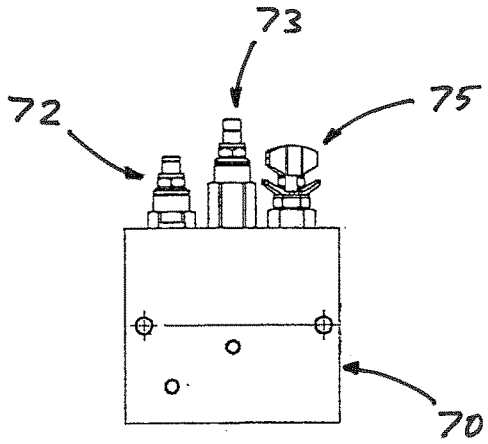
FIG. 4A is a first or front side view of an example embodiment tramp iron relief cylinder manifold block for the tramp iron relief system illustrated in FIG. 1.
Figure 4B:
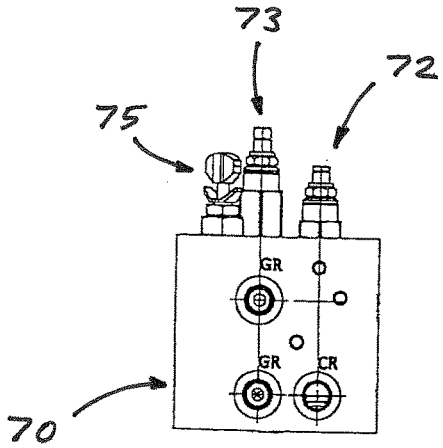
FIG. 4B is a left side view of the tramp iron relief cylinder manifold block illustrated in FIG. 4A.
Figure 4C:
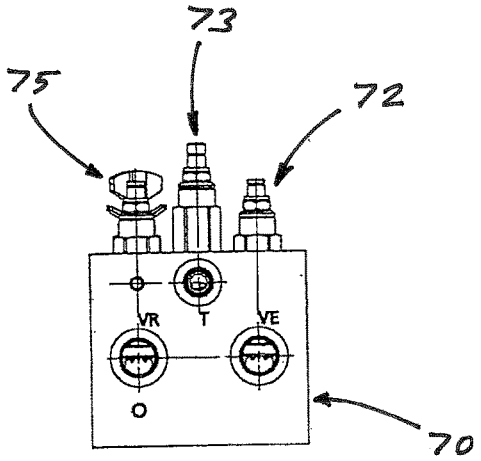
FIG. 4C is a back side view of the tramp iron relief cylinder manifold block illustrated in FIGS. 4A-4B.
Figure 4D:
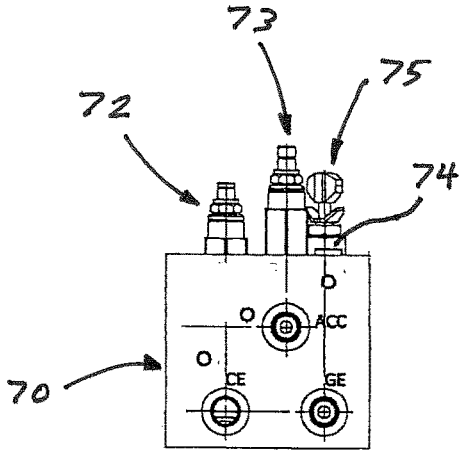
FIG. 4D is a right side view of the tramp iron relief cylinder manifold block illustrated in FIGS. 4A-4C.
Figure 4E:
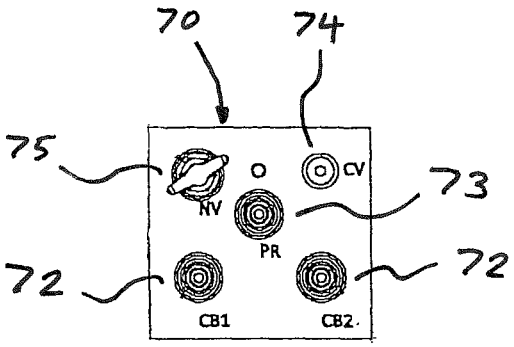
FIG. 4E is a top view of the tramp iron relief cylinder manifold block illustrated in FIGS. 4A-4D.
Figure 4F:
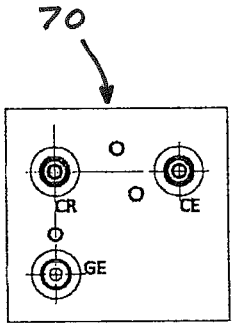
FIG. 4F is a bottom view of the tramp iron relief cylinder manifold block illustrated in FIGS. 4A-4E.
Figure 4G:
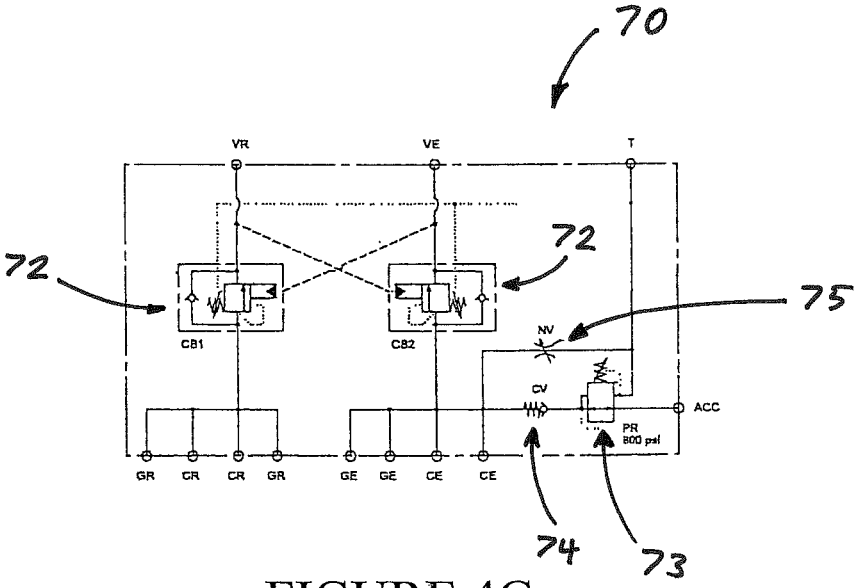
FIG. 4G is a schematic view illustrating generally the interrelation of components of the example embodiment tramp iron relief cylinder manifold block illustrated in FIGS. 4A-4F.

Referring now to FIG. 4G, a schematic view illustrating generally the interrelation of components of preferred tramp iron relief cylinder manifold block 70 is illustrated. As shown in FIG. 4G, preferred tramp iron relief cylinder manifold block 70 comprises counterbalance valves 72, pressure reducing valve 73, check valve 74, and pressure release valve 75. As previously shown in FIG. 3 (but not shown in FIG. 4G), preferred tramp iron relief cylinder manifold block 70 generally also has attached at least one of pressure transducer 76 and a pressure gauge.

Referring now to FIGS. 5A-5E, preferred tension cylinder manifold block 90 is illustrated. As shown in FIGS. 5A-5E, preferred tension cylinder manifold block 90 comprises adjustable relief valve 92 and counterbalance valves 94. As previously shown in FIG. 3 (but not shown in FIGS. 5A-5E), preferred tension cylinder manifold block 90 generally also has attached at least one of pressure transducer 96 and a pressure switch.

Figure 5F:
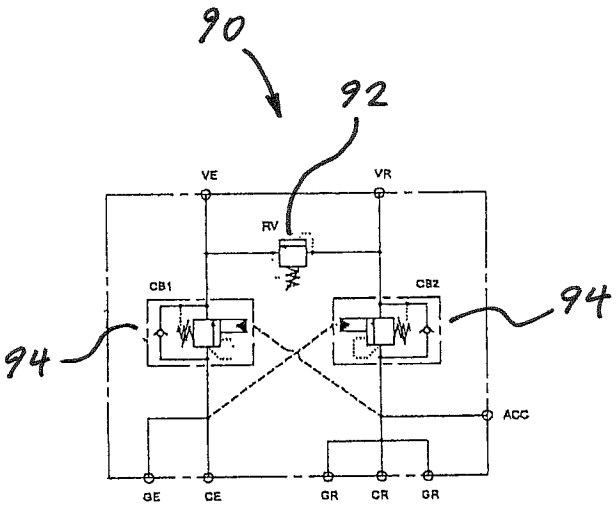
FIG. 5F is a schematic view illustrating generally the interrelation of components of the example embodiment tension cylinder manifold block illustrated in FIGS. 5A-5E.
Figure 5E:
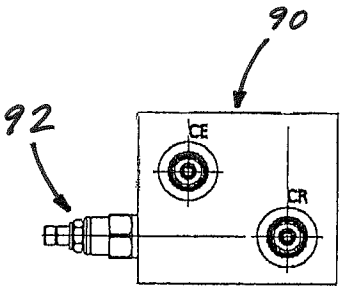
FIG. 5E is a bottom view of the tension cylinder manifold block illustrated in FIGS. 5A-5D.
Figure 5D:
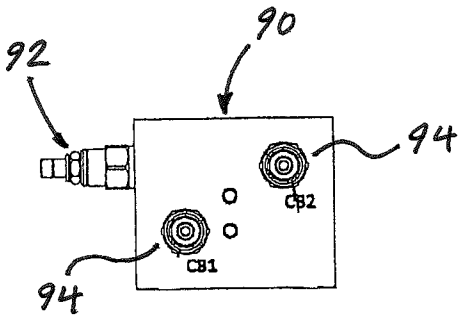
FIG. 5D is a top view of the tension cylinder manifold block illustrated in FIGS. 5A-5C.

Referring now to FIG. 5F, a schematic view illustrating generally the interrelation of components of preferred tension cylinder manifold block 90 is illustrated. As shown in FIG. 5F, preferred tension cylinder manifold block 90 comprises adjustable relief valve 92 and counterbalance valves 94. As previously shown in FIG. 3 (but not shown in FIG. 5F), preferred tension cylinder manifold block 90 generally also has attached at least one of pressure transducer 96 and a pressure switch.

Thus, it may be seen that, in preferred embodiments of the present invention, the apparatus of the invention comprises a tramp iron relief system for a jaw crusher having a movable jaw and a stationary jaw defining a crushing chamber for crushing aggregate material. The preferred tramp iron relief system comprises a tramp iron relief cylinder having a rod end and a base end and being adapted to limit and/or release pressure on the movable jaw of the jaw crusher when tramp iron is present in the crushing chamber. The preferred tramp iron relief cylinder is also adapted to receive oil to exert pressure on the movable jaw during crushing operations and includes a relief valve that is adapted to provide a quick discharge path for oil in the tramp iron relief cylinder when open. The preferred relief valve is also adapted to open when oil pressure within the tramp iron relief cylinder exceeds a pre-designated limit. The preferred tramp iron relief system also comprises a tramp iron relief cylinder manifold block that is adapted to control the flow of oil into and out of the tramp iron relief cylinder. The preferred tramp iron relief system further comprises a tension cylinder that is adapted to provide tension force to keep the tramp iron relief cylinder in operative contact with the movable jaw of the jaw crusher during crushing operations. The preferred tension cylinder is also adapted to receive oil. The preferred tramp iron relief system still further comprises a tension cylinder manifold block that is adapted to control the flow of oil into and out of the tension cylinder, a tank line accumulator that is adapted to receive and hold oil discharged from the tramp iron relief cylinder when the relief valve is open, and a hydraulic line and/or hydraulic network to convey oil between the tank line accumulator, the tramp iron relief cylinder, and the tension cylinder.

The claimed invention also comprises a method for reducing the movement of a tramp iron relief cylinder on a jaw crusher during crushing operations. The preferred method comprises providing a tramp iron relief system for a jaw crusher having a movable jaw and a stationary jaw defining a crushing chamber for crushing aggregate material. The preferred tramp iron relief system comprises a tramp iron relief cylinder having a rod end and a base end and being adapted to limit and/or relieve pressure on the movable jaw of the jaw crusher when tramp iron is present in the crushing chamber. The preferred tramp iron relief cylinder is also adapted to receive and/or contain oil to exert pressure on the movable jaw during crushing operations and includes a relief valve that is adapted to provide a quick discharge path for oil in the tramp iron relief cylinder when open. The preferred relief valve is also adapted to open when oil pressure within the tramp iron relief cylinder exceeds a pre-designated limit. The preferred tramp iron relief system also comprises a tramp iron relief cylinder manifold block that is adapted to control the flow of oil into and out of the tramp iron relief cylinder. The preferred tramp iron relief system further comprises a tension cylinder that is adapted to provide tension force to keep the tramp iron relief cylinder in operative contact with the movable jaw of the jaw crusher during crushing operations. The preferred tension cylinder is also adapted to receive oil. The preferred tramp iron relief system still further comprises a tension cylinder manifold block that is adapted to control the flow of oil into and out of the tension cylinder, a tank line accumulator that is adapted to receive and hold oil discharged from the tramp iron relief cylinder when the relief valve is open, and a hydraulic line to convey oil between the tank line accumulator, the tramp iron relief cylinder, and the tension cylinder. The preferred method also comprises reducing the pressure in the rod end of the tramp iron relief cylinder during crushing operations of the jaw crusher. In other preferred embodiments of the method of the invention, the method further comprises applying pressure to the base end of the tramp iron relief cylinder during crushing operations of the jaw crusher.

In various example embodiments, a preferred tramp iron relief system comprises a tramp iron relief cylinder having a rod end and a base end and being adapted to increase opening of the jaw crusher when tramp iron is present in the crushing chamber. The preferred tramp iron relief cylinder is also adapted to maintain the open condition of the movable jaw during crushing operations and includes a relief valve that is adapted to provide a quick discharge path for oil in the tramp iron relief cylinder when open. The preferred relief valve is also adapted to open when oil pressure within the tramp iron relief cylinder exceeds a pre-designated limit.

In operation, several advantages of the preferred embodiments of the tramp iron relief system in accordance with the present invention are achieved. For example, the two tramp iron relief cylinders include a relief valve and a check valve. The relief valve is set at a given pressure so when the crushing force exceeds this pressure the tramp iron relief cylinders will retract and the jaw will open, i.e. the moveable jaw will move away from the stationary jaw. This usually only happens when an uncrushable enters the jaw chamber. When the oil passes through the relief valve, some of it will pass over a check valve and enter the rod end of the cylinder and the rest will go to the tank line accumulator. This accumulator takes the pulsating high flow rate from the tramp iron relief cylinders and evens out and slows the flow rate to the tank.

In the preferred embodiments of the tramp iron relief system in accordance with the present invention, the tension cylinder provides the tension force to keep the tramp iron relief cylinders in contact with the pitman during normal crushing operations. During normal crushing operations, oil pressure is supplied to the rod end and the cylinder base end is open to the tank. During certain maintenance and repair procedures, the tension cylinder is used to push the pitman forward so the tramp iron relief cylinders can be removed.

Also in the preferred embodiments of the tramp iron relief system in accordance with the present invention, the two accumulators serve different functions. More particularly, the tank line accumulator handles the excess flow from the tramp iron relief cylinders during an uncrushable event. The tension cylinder accumulator stores the oil and maintains the pressure in the rod end of the tension cylinder along with supplying oil to the tramp iron relief manifold which supplies the oil to the base end of the tramp iron relief cylinders.

Further, in the preferred embodiments of the tramp iron relief system in accordance with the present invention, the tension cylinder manifold block comprises two counterbalance valves, an adjustable relief valve and a pressure transducer or a pressure switch. The tension cylinder manifold block is designed so the oil pressure on the cylinder side of the manifold will open the counterbalance valve for the other port so pressure cannot be held on both sides of the tension cylinder at any time. Preferably, the relief valve controls the pressure of the oil going to the rod end of the tension cylinder and to the tension cylinder accumulator.

Still further, in the preferred embodiments of the tramp iron relief system in accordance with the present invention, the pressure transducer or pressure switch on the tension cylinder manifold block sends a signal to the controller when the pressure has reached a predetermined minimum Preferably, the controller then sends a signal to the two-section solenoid valve to direct oil to the tension cylinder accumulator. This preferably causes the pressure level of the oil to increase until it reaches the pressure setting of the adjustable relief valve in the tension cylinder manifold block.

Still further, in the preferred embodiments of the tramp iron relief system, a primary purpose of the pressure reducing valve is to control the pressure applied to the base end of the tramp iron relief cylinders before crushing. The pressure in the base ends of the tramp iron relief cylinders creates pressure in the rod ends of the cylinders. When crushing begins, the pressure in the base ends of the tramp iron relief cylinders increases and the pressure in the rod ends of the tramp iron relief cylinders decreases. This reduces the movement of the cylinder rods 23 and 25 in relationship to the base of the tramp iron relief cylinders which reduces the wear on the seals 22S1, 22S2, 24S1, and 24S2 of the tramp iron relief cylinders and increases the projected useful life of the cylinders.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A tramp iron relief system for a jaw crusher having a movable jaw and a stationary jaw defining a crushing chamber for crushing aggregate material and a plurality of seals of a tramp iron relief cylinder, said tramp iron relief system comprising:

(a) the tramp iron relief cylinder having a base end and a rod end and being adapted to limit pressure on the movable jaw of the jaw crusher when tramp iron is present in the crushing chamber, said tramp iron relief cylinder being adapted to receive oil to exert pressure on the movable jaw during crushing operations, said tramp iron relief cylinder including a relief valve adapted to provide when open a discharge path for oil in said tramp iron relief cylinder, said relief valve being adapted to open when oil pressure within said tramp iron relief cylinder exceeds a pre-designated limit;

(b) a tramp iron relief cylinder manifold block adapted to control the flow of oil into and out of said tramp iron relief cylinder, said tramp iron relief cylinder manifold block having a pressure reducing valve;

(c) a tension cylinder adapted to provide tension force to keep said tramp iron relief cylinder in operative contact with the movable jaw of the jaw crusher during crushing operations, said tension cylinder being adapted to receive oil;

(d) a tension cylinder manifold block adapted to control the flow of oil into and out of said tension cylinder;

(e) a tension cylinder accumulator, said tension cylinder accumulator being adapted to automatically supply said oil to the base end of the tramp iron relief cylinder in order to pressurize the base end of the tramp iron relief cylinder;

(f) a tank line accumulator adapted to receive and hold oil discharged from said tramp iron relief cylinder when said relief valve is open; and (g) a hydraulic network to convey oil between said tank line accumulator, said tramp iron relief cylinder, and said tension cylinder;

wherein the tramp iron relief system pressurizes the base end of the tramp iron relief cylinder during normal crushing operations; and wherein said pressure reducing valve is adapted to automatically control and adjust pressure in the base end of the tramp iron relief cylinder; and wherein the tramp iron relief system reduces movement of the tramp iron relief cylinder during normal crushing operations; and wherein the tramp iron relief system reduces wear on the plurality of seals of the tramp iron relief cylinder by reducing the movement of a cylinder rod in relationship to the base end of the tramp iron relief cylinder.

2. The tramp iron relief system of claim 1 wherein said tramp iron relief system comprises two tramp iron relief cylinders.

3. The tramp iron relief system of claim 1 wherein the tramp iron relief cylinder further comprises a check valve.

4. The tramp iron relief system of claim 1 wherein said tramp iron relief cylinder manifold block comprises a counterbalance valve, the pressure reducing valve, a check valve, a pressure release valve, and at least one of a pressure transducer and a pressure gauge.

5. The tramp iron relief system of claim 1 further comprising a two-way solenoid valve.

6. The tramp iron relief system of claim 1 wherein the tension cylinder manifold block comprises a counterbalance valve, an adjustable relief valve, and at least one of a pressure transducer and a pressure switch.

7. The tramp iron relief system of claim 6 wherein the pressure transducer conveys a signal to a controller in the event a pre-determined minimum pressure level is present.

8. The tramp iron relief system of claim 1 further comprising a tank.

9. The tramp iron relief system of claim 1 further comprising an orifice fitting.

* * * * *